United States Patent [19]

Robertson

[11] Patent Number: 4,646,477

[45] Date of Patent: Mar. 3, 1987

[54] KNIFE SHARPENER

[76] Inventor: William M. Robertson, 1315 James Ave., Albert Lea, Minn. 56007

[21] Appl. No.: 672,411

[22] Filed: Nov. 16, 1984

[51] Int. Cl.[4] ..... B24B 3/54

[52] U.S. Cl. ..... 51/204; 51/212; 51/214; 76/86; 76/82; 76/88

[58] Field of Search ..... 51/204, 205 R, 205 WG, 51/211 R, 211 H, 212, 214, 354; 33/495; 76/82.2, 82, 86, 88, 84; 224/269; 7/168, 202; 308/2

[56] References Cited

U.S. PATENT DOCUMENTS

| | | | |
|---|---|---|---|
| 691,728 | 1/1902 | Norfolk | 33/496 |
| 781,629 | 2/1905 | Ahlström | 224/269 X |
| 1,165,245 | 12/1915 | Goodwin | 76/86 |
| 1,429,984 | 9/1922 | Vollmer | 76/86 |
| 2,460,552 | 2/1949 | Tarapczynski | 51/354 |
| 2,462,729 | 2/1949 | Deck | 81/58.1 |
| 4,428,515 | 1/1984 | Mayer | 7/120 |

FOREIGN PATENT DOCUMENTS

| | | | |
|---|---|---|---|
| 0263073 | 3/1929 | Italy | 76/86 |
| 0869491 | 5/1961 | United Kingdom | 51/214 |

*Primary Examiner*—Frederick R. Schmidt
*Assistant Examiner*—Robert A. Rose
*Attorney, Agent, or Firm*—Merchant, Gould, Smith, Edell, Welter & Schmidt

[57] ABSTRACT

A knife sharpener (10) includes a pair of arms (12, 14) pivoted together at their inner ends about a shaft (22) to provide continuous adjustment of the angular orientation between sharpening sticks (24, 26) which are seated in the outer ends of the handles for continuous rotational adjustment, in order to provide precise sharpening.

14 Claims, 3 Drawing Figures

KNIFE SHARPENER

TECHNICAL FIELD

The present invention relates generally to a knife sharpener, and more particularly to a convenient knife sharpener of compact size which can be angularly and rotationally adjusted over continuous ranges to obtain precision sharpening.

BACKGROUND ART

Knives and other blades traditionally have been sharpened by hand using a sharpening stone. The stone is held in one hand while the knife is held in the other and rubbed against the stone. However, this method of sharpening knives can be dangerous since the blade can slip from the stone and cut the hand holding the stone. Further, the knife must be turned to sharpen both sides of the knife blade, which is tedious and time-consuming and which requires some practice to achieve good sharpening.

Although various knife sharpeners have been available heretofore having pairs of sharpening elements between which the knife blade is drawn, the sharpeners of the prior art have not been altogether satisfactory. In particular, the prior knife sharpeners have not been adapted to provide continuous adjustment of the angle between the sharpening elements and continuous adjustment of the surface portions of the sharpening elements across which the knife blades are drawn, in order to obtain precise sharpening. For example, U.S. Pat. No. 4,259,815 to Kuban shows a device wherein the sharpening members pivot from secured positions in a handle to upwardly inclined extended positions defined by stops which do not provide for either angular or rotational adjustment. U.S. Pat. Nos. 3,894,362 to Graves and 1,429,984 to Vollmer show devices wherein the sharpening members are secured in fixed angular relationship but can be rotationally adjusted to present fresh surfaces to the bladed edges. U.S. Pat. No. 4,231,194 to Glesser shows a device wherein the sharpening members can be located in different discrete orientations on a base, but cannot be continuously adjusted in either manner.

It will be appreciated that achieving and maintaining precise knife sharpening is important to butchers and meat cutters, who must periodically stop their work to resharpen their knives. Dull knife blades contribute toward fatigue and reduced productivity. Heretofore, however, there has not been available a knife sharpener which provides for continuous adjustment of the angle between the sharpening elements and their work surfaces in a safe and convenient manner so as to facilitate precise knife sharpening. There is thus a need for such an improved sharpener.

SUMMARY OF INVENTION

The present invention comprises an improved knife sharpener which overcomes the foregoing and other difficulties associated with the prior art. In accordance with the invention, there is provided a knife sharpener comprising a pair of oppositely-extending arms interconnected at their inner ends for adjustable pivotal movement about a transverse axis. A pair of sharpening sticks are seated in the outer ends of the arms, which can be pivotally adjusted to cross the sticks at the desired angle. Each sharpening stick is snugly engaged seated in the outer end of the respective arm for rotation about its longitudinal axis to adjust the work surface as necessary to obtain precise sharpening. In a first embodiment, a finger wheel is secured near the base of each sharpening element for effecting manual rotation thereof without special tools. In a second embodiment, opposing flats are provided on each sharpening element for cooperation with a wrench to effect rotational adjustment thereof. If desired, the blade sharpener can be provided with a suspension ring, chain and belt clip for convenience and portability.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
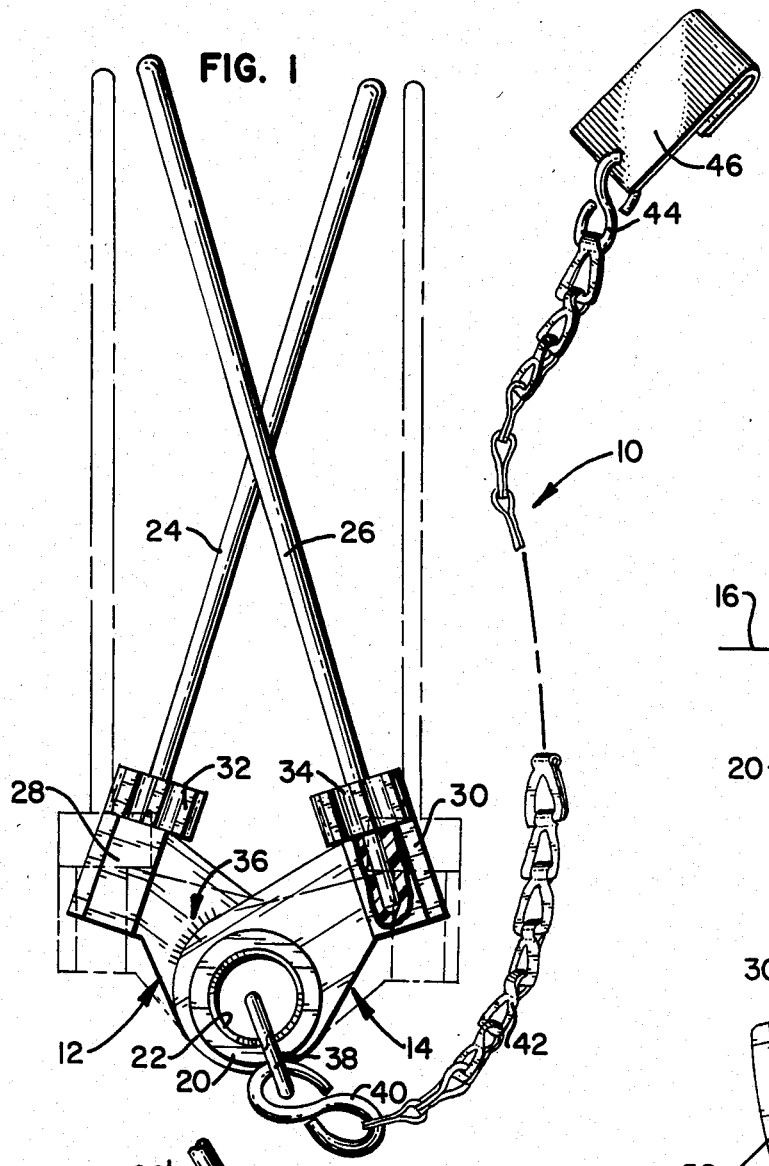
FIG. 1 is a front view of a blade sharpener incorporating a first embodiment of the invention, showing one position thereof in solid lines and another position in phantom lines, with a portion cut away for clarity.
Figure 2:
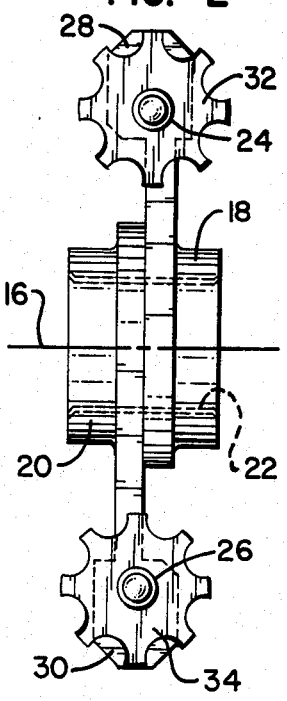
FIG. 2 is a top plan view of the blade sharpener of FIG. 1.

Referring now to the Drawings, wherein like reference numerals designate like or corresponding elements throughout the views, and particularly referring to FIGS. 1 and 2, there is shown the knife sharpener 10 incorporating the first embodiment of the invention. FIG. 1 shows the sharpener 10 with its sharpening elements crossed for sharpening a knife or the like, in full lines, while the phantom lines depict them uncrossed for dressing with an emery cloth or the like. As will be explained more fully hereinafter, the sharpener 10 provides for continuous angular and rotational adjustment of the sharpening elements in order to achieve precision sharpening.

The knife sharpener 10 includes a pair of arms 12 and 14 which are interconnected at their inner ends for pivotal movement about a transverse axis 16. The handles 12 and 14 can be formed from any suitable material, such as nylon, polyurethane or other appropriate plastic. In the preferred embodiment, the inner ends of arms 12 and 14 include raised boss portions 18 and 20, respectively, which are mounted for pivotal movement about a hollow shaft 22. The ends of shaft 22 are preferably flared as shown to retain arms 12 and 14 thereon. The shaft 22 can be formed from stainless steel or other suitable material. The bosses 18 and 20 of handles 12 and 14, respectively, are snugly secured on shaft 22 by means of an interference fit so as to allow pivotal movement while maintaining the angular relationship between the handles after adjustment.

A pair of sharpening sticks 24 and 26 are mounted in the solid outer ends 28 and 30 of arms 12 and 14, respectively. The sharpening sticks 24 and 26 are preferably equidistant from the axis 16, but slightly longitudinally offset to permit crossing. These sharpening sticks 24 and 26 can comprise elongate pieces of steel, ceramic or other suitable sharpening material. The base ends of the sharpening sticks 24 and 26 are snugly seated in blind bores formed in the outer ends 28 and 30 of arms 12 and 14, respectively, as best shown in FIG. 1 by means of an interference fit so as to allow rotation while maintaining their rotational position after adjustment.

Finger wheels 32 and 34 are secured near the base ends of the sharpening sticks 24 and 26, respectively, to facilitate manual rotational adjustment thereof in order to present a fresh "dressed" surface for sharpening. The finger wheels 32 and 34 can be formed from nylon, polyurethane, or other suitable plastic similar to arms 12 and 14. The finger wheels 32 and 34 also serve a safety purpose by helping to shield the hand of the user holding the knife sharpener 10.

In accordance with the preferred embodiment, index marks 36 can be provided on adjacent surfaces of arms 12 and 14 to facilitate the desired angular adjustment between the sharpening sticks 24 and 26. A ring 38, hook 40, chain 42, second hook 44, and belt clip 46 can also be provided to facilitate carrying the knife sharpener 10 in convenient reach for ready use in the usual fashion, after angular and rotational adjustment of the sharpening sticks 24 and 26, to sharpen the blade of the knife at hand.

Figure 3:
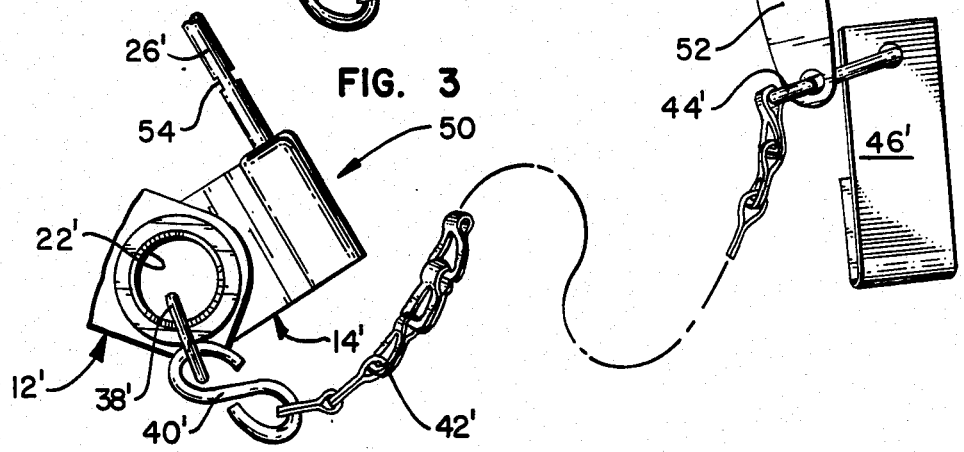
FIG. 3 is a partial front view of a blade sharpener incorporating a second embodiment of the invention.

FIG. 3 illustrates a portion of a knife sharpener 50 incorporating a second embodiment of the invention. The sharpener 50 incorporates components which are substantially similar to components of the blade sharpener 10 of the first embodiment. Such components have been identified with the same reference numerals utilized in connection with the description of the sharpener 10, but have been differentiated therefrom by means of prime (') notations.

The primary distinction between the two embodiments comprises the fact that the blade sharpener 50 utilizes sharpening sticks having flats thereon, together with a wrench 52 for effecting rotational adjustment thereof, instead of finger wheels 32 and 34 as in the first embodiment. For example, a pair of wrench flats 54 are shown on the sharpening element 26', and a similar set of wrench flats (not shown) are provided on the other sharpening element. Arms 12' and 14' are of generally rectangular configuration. In all other respects, the knife sharpener 50 functions the same as the sharpener 10.

From the foregoing, it will thus be apparent that the present invention comprises an improved knife sharpener having several advantages over the prior art. The sharpener herein provides for continuous angular and rotational adjustment of the sharpening elements in an easy and convenient manner to provide precision sharpening. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. Apparatus for sharpening blades of knives and the like, comprising:

a pair of oppositely extending arms each having inner and outer ends, the inner ends of said arms overlapping;

means for interconnecting the inner ends of said arms for adjustable pivotal movement about a transverse axis;

a pair of elongate sharpening sticks snugly seated in blind bores formed in the outer ends of said arms for adjustable pivotal movement therewith into and out of crossing relationship, and for adjustable rotational movement about their respective longitudinal axes; and finger wheel means secured to said sharpening sticks adjacent said arms for effecting manual rotational adjustment thereof, said finger wheel means being radially larger than said sticks to act also as finger guards.

2. The apparatus of claim 1, wherein said arms are formed of plastic.

3. The apparatus of claim 1, wherein said sharpening sticks are formed of steel.

4. The apparatus of claim 1, wherein said sharpening sticks are formed of ceramic.

5. The apparatus of claim 1, wherein said pivotal interconnecting means comprises a hollow shaft extending in interfering engagement through aligned openings in the inner ends of said arms, the opposite ends of said shaft being flared to retain said arms thereon.

6. The apparatus of claim 1, further including:

indicia on associated surfaces of the inner ends of said arms defining a gauge for the angular setting of said arms.

7. The apparatus of claim 1, further including:

a ring secured to said arms;

a first hook secured to said ring;

a second hook;

a chain interconnecting said first and second hooks; and a belt clip secured to said second hook.

8. A knife sharpener, comprising:

a pair of oppositely extending arms having inner and outer ends, the inner ends of said arms overlapping;

a hollow shaft extending in an interference fit through aligned openings in the inner ends of said arms for adjustable pivotal movement of said arms about a transverse axis, opposite ends of said shaft being flared to retain said arms thereon;

a pair of elongate sharpening sticks seated in blind bores formed in the outer ends of said arms for adjustable pivotal movement therewith into and out of crossing relationship, and for adjustable rotational movement of said sticks about their respective longitudinal axes; and a pair of finger wheels, each secured to a respective one of said sharpening sticks adjacent the outer ends of said arms for effecting manual rotational adjustment thereof, said finger wheels being radially larger than said sticks to act also as finger guards.

9. The apparatus of claim 8, wherein said arms are formed of plastic.

10. The apparatus of claim 8, wherein said sharpening sticks are formed of steel.

11. The apparatus of claim 8, wherein said sharpening sticks are formed of ceramic.

12. The apparatus of claim 8, further including: indicia on associated surfaces of the inner ends of said arms defining a gauge for the angular setting of said arms.

13. The apparatus of claim 8, further including:

a ring secured to said arms;

a first hook secured to said ring;

a second hook;

a chain interconnecting said first and second hooks; and a belt clip secured to said second hook.

14. A knife sharpener, comprising:

a pair of oppositely extending arms each having inner and outer ends, the inner ends of said arms overlapping;

means extending in an interference fit through aligned openings in the inner ends of said arms for adjustable pivotal movement of said arms about a transverse axis;

a pair of elongate sharpening sticks snugly seated in blind bores formed in the outer ends of said arms for adjustable pivotal movement therewith into and out of crossing relationship, and for adjustable rotational movement of said sticks about their respective longitudinal axes to expose fresh surfaces for sharpening;

a pair of finger wheels, each secured to a respective one of said sharpening sticks adjacent the outer ends of said arms for effecting manual rotational adjustment thereof, said finger wheels being radially larger than said sticks to act also as finger guards;

indicia on associated surfaces of the inner ends of said arms defining a gauge for the angular setting of said arms;

a ring secured to at least one of said arms; and means including a clip connected to said ring for suspending the sharpener from a belt for portability and convenience.

* * * * *